US005083957A

United States Patent [19]

Bolz et al.

[11] Patent Number: 5,083,957

[45] Date of Patent: Jan. 28, 1992

[54] METHOD OF SELECTING TELEVISION DISPLAY TUBES IN WHICH THE VACUUM IS TOO LOW

[75] Inventors: André Bolz, Aachen; Hermann Wehr, Eschweiler, both of Fed. Rep. of Germany

[73] Assignee: U.S. Philips Corporation, New York, N.Y.

[21] Appl. No.: 599,784

[22] Filed: Oct. 18, 1990

[30] Foreign Application Priority Data

Oct. 28, 1989 [DE] Fed. Rep. of Germany ..... 3936015

[51] Int. Cl.[5] ..... H01J 9/42

[52] U.S. Cl. ..... 445/3; 445/6

[58] Field of Search ..... 445/3, 5, 6

[56] References Cited

U.S. PATENT DOCUMENTS 4,720,652 1/1988 Dubois, Jr. ..... 445/3

FOREIGN PATENT DOCUMENTS 0073526 4/1987 Japan ..... 445/3

0656126 4/1979 U.S.S.R. ..... 445/3

*Primary Examiner*—Richard K. Seidel

*Assistant Examiner*—Jeffrey T. Knapp

*Attorney, Agent, or Firm*—John C. Fox

[57] ABSTRACT

So as to detect and remove tubes having too low a vacuum before gettering, a d.c. voltage which continuously increases from a low value to a maximum value is applied between the anode (g4) and a second electrode (g3) of a television display tube, the increase in this voltage being stopped as soon as a spark discharge current flows in the tube. The associated value of the d.c. voltage is evaluated as a criterion for the selection of the tubes.

9 Claims, 1 Drawing Sheet

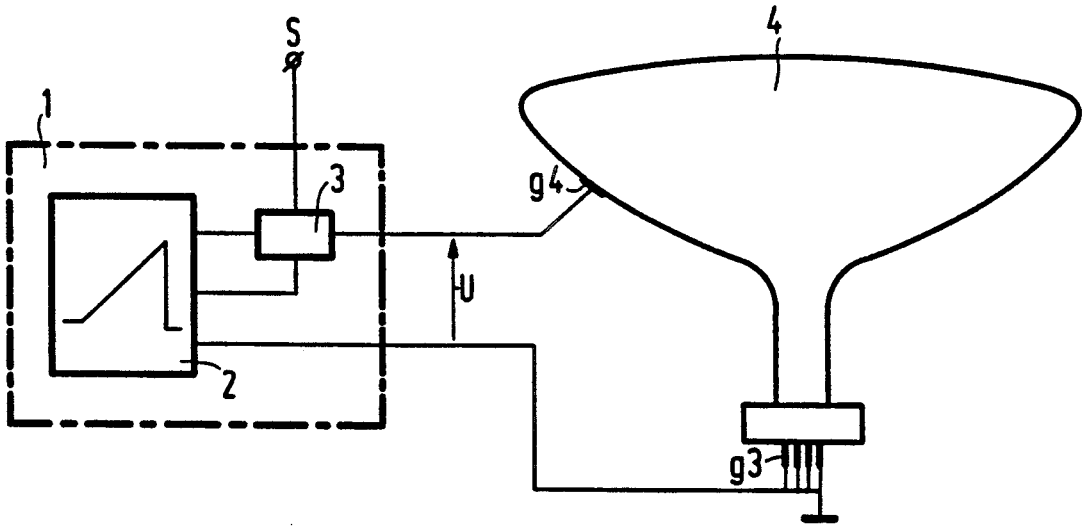
S
1
3
4
g4
U
2
g3

METHOD OF SELECTING TELEVISION DISPLAY TUBES IN WHICH THE VACUUM IS TOO LOW

BACKGROUND OF THE INVENTION

The invention relates to a method of selecting television display tubes in which the vacuum is too low during manufacture.

In the manufacture of television display tubes, colour display tubes in particular, it is important that, during the manufacturing process, all the display tubes having too low a vacuum are timely removed, so that they are not changed such that during further manufacturing steps, for example during gettering, that repair/recycling of these tubes is rendered more difficult of even impossible.

To detect whether a tube has a vacuum which is too low it has been customary to apply a pulsed high voltage between two electrodes which are fed-out from the tube base, for example the grids (g2) and (g3), and to measure the resulting ionization current.

This method is comparatively unreliable because the insulating currents within the tube base are included in the measured currents.

OBJECTS AND SUMMARY OF THE INVENTION

The invention has therefore for its object to provide a method of the type defined in the opening paragraph that operates in a simple and reliable manner, and does not substantially corrupt the selection of the tubes by including insulating currents.

According to the invention, this object is accomplished by applying between the anode (g4) and a second electrode of the tube a d.c. voltage, continuously increasing the voltage from a low value to a maximum value, stopping the increase as soon as a spark or discharge current flows in the tube, and evaluating the associated value of the d.c. voltage as a criterion for the selection of the tubes.

In the method in accordance with the invention, the insulating currents within the tube base are not included in the measured result. Furthermore, the measuring circuit can be of a significantly simpler structure, since in this method no small current must be measured at a constantly applied voltage, but only the instant (and the associated voltage value) at which a current starts to flow in the tube must be measured. The focussing electrode (g3) is preferably utilized as the second electrode.

To ensure that all parasitic currents are eliminated, the second and all further electrodes (the anode excepted) are preferably connected to ground potential.

It is particularly advantageous to perform the method of the invention before gettering of the tubes to ensure that tubes having too low a vacuum are timely removed from the manufacturing procedure. These tubes can then optionally be evacuated once again. If on the contrary tubes with too low a vacuum are gettered, there is always the risk that getter material evaporates irregularly and incompletely. The getter then becomes brittle and results in so-called "loose particles" in the tubes.

BRIEF DESCRIPTION OF THE DRAWING

The invention will now, by way of example, be described in greater detail with reference to an embodiment shown in the accompanying drawing.

The FIGURE is a schematic view of a test arrangement for performing the method of the invention, connected to a television display tube.

The arrangement 1 comprises a voltage generator 2, which produces a d.c. voltage U which continuously increases from a low value to a maximum value and is applied between the anode (g4) and the focussing electrode (g3) of the tube 4. In this situation the focussing electrode is connected to ground potential together with all the other electrodes fed-out from the tube base.

In the connection between the voltage generator 2 and the tube 4, a detection circuit 3 is incorporated which, from its output S, supplies a signal as soon as current flows in the tube between the anode (g4), and also the focussing electrode (g3) and provides that the voltage U does not increase any further.

The voltage U of the voltage generator 2 increases at an approximate rate of 3 kV/sec to its maximum value. The voltage U generated by the voltage generator 2 is adjusted such that at its maximum value (for example 20 kV) no output S occurs in a tube having an appropriate vacuum.

If the vacuum in the tube 4 is below a preset value (before gettering) of approximately 1 to 20 Pa, then at a voltage value below the maximum value, a current flows which results in a signal at the selection output S, which signal then causes this tube to be removed from the manufacturing run. Thus it is possible to test with a simpler arrangement, without the selection being corrupted by insulating currents flowing in the tube base, whether a tube has a given minimum vacuum, and to select tubes in which this is not the case.

We claim:

1. A method of selecting television display tubes in which the vacuum is unsuitable during manufacture, characterized by, applying a d.c. voltage between the anode and a second electrode of the tube, continuously increasing the voltage from a low value to a maximum value, stopping the increase as soon as a spark or discharge current flows in the tube, and evaluating the associated value of the d.c. voltage as a criterion for the selection of the tubes.

2. A method as claimed in claim 1, characterized by, using the focussing electrode as the second electrode.

3. A method as claimed in claim 1, characterized by, the focussing electrode and all the further electrodes except the anode to ground potential.

4. A method as claimed in claim 1, characterized by, performing the method before gettering the tubes.

5. A method as claimed in claim 2, characterized by, connecting the focussing electrode and all the further electrodes except the anode to the ground potential.

6. A method as claimed in claim 2, characterized by, performing the method before gettering the tubes.

7. A method as claimed in claim 3, characterized by, performing the method before gettering the tubes.

8. A method as claimed in claim 4, characterized by, performing the method before gettering the tubes.

9. A method as claimed in claim 5, characterized by, performing the method before gettering the tubes.

* * * * *